US007187334B2

(12) United States Patent
Franson et al.

(10) Patent No.: US 7,187,334 B2
(45) Date of Patent: Mar. 6, 2007

(54) PATCH ARRAY FEED FOR AN AUTOMOTIVE RADAR ANTENNA

(75) Inventors: Steven J. Franson, Scottsdale, AZ (US); Rudy M. Emrick, Gilbert, AZ (US)

(73) Assignee: Motorola, Inc., Schaumburg, IL (US)

( * ) Notice: Subject to any disclaimer, the term of this patent is extended or adjusted under 35 U.S.C. 154(b) by 53 days.

(21) Appl. No.: 10/978,675

(22) Filed: Oct. 29, 2004

(65) Prior Publication Data

US 2006/0092076 A1 May 4, 2006

(51) Int. Cl.
*H01Q 1/32* (2006.01)
*H01Q 19/12* (2006.01)

(52) U.S. Cl. ..... 343/713; 343/700 MS; 343/840

(58) Field of Classification Search ..... 343/711, 343/712, 713, 840, 700 MS
See application file for complete search history.

(56) References Cited

U.S. PATENT DOCUMENTS

| | | | | |
|---|---|---|---|---|
| 5,579,021 | A | 11/1996 | Lee | |
| 5,912,645 | A * | 6/1999 | Wight et al. | 343/700 MS |
| 6,014,108 | A | 1/2000 | Lynch | |
| 6,091,363 | A * | 7/2000 | Komatsu et al. | 343/700 MS |
| 6,396,448 | B1 | 5/2002 | Zimmerman | |
| 6,400,308 | B1 | 6/2002 | Bell | |
| 6,480,160 | B1 | 11/2002 | Bjornholt et al. | |
| 6,542,111 | B1 | 4/2003 | Wilson | |
| 6,563,456 | B1 | 5/2003 | Hamman et al. | |
| 6,646,620 | B1 | 11/2003 | Bjornholt et al. | |
| 6,700,542 | B2 | 3/2004 | Borlez | |
| 2004/0119633 | A1 | 6/2004 | Oswald | |
| 2004/0150549 | A1 | 8/2004 | Kumon | |
| 2004/0155811 | A1 | 8/2004 | Albero | |

FOREIGN PATENT DOCUMENTS

GB 2242316 A 9/1991

OTHER PUBLICATIONS

Ramesh Garg, Prakash Bhartia, Inder Bahl, Apisak Ittipiboon, Microstrip Antenna Design Handbook, published by Artech House pp. 18-14, 28-29, 480-487, 493-497 Norwood, MA USA (2001).
David M. Pozar, Microwave Engineering, published by Addison-Wesley, pp. 183-184, 199-200 USA (1990).
David M. Pozar, Design of Millimeter Wave Microstrip Reflectarrays, IEEE Transactions on Antennas and Propgation, vol. 45, No. 2, pp. 287-296 USA (Feb. 1997).

* cited by examiner

*Primary Examiner*—Tan Ho
(74) *Attorney, Agent, or Firm*—Thomas V. Miller; Terri S. Hughes; Gary J. Cunningham

(57) ABSTRACT

An improved transceiver assembly for a vehicle for detecting potentially hazardous objects is disclosed. The transceiver assembly preferably comprises a patch array feed antenna having an array of a plurality of patches for generating a beam and for detecting the beam as reflected from the potential hazards. The antenna is formed in or on a housing which also contains a parabolic dish that moves to sweeps the beam of radiation towards the potential hazards outside of the vehicle. In a preferred embodiment, approximately 77 GHz radiation is generated from and detected by the antenna.

43 Claims, 4 Drawing Sheets

PATCH ARRAY FEED FOR AN AUTOMOTIVE RADAR ANTENNA

CROSS REFERENCE TO RELATED APPLICATION

This application is related to an application filed concurrently herewith, entitled "Tapered Slot Feed for an Automotive Radar Antenna," U.S. application. Ser. No. 10/978,779, now pending which is incorporated herein by reference in its entirety.

FIELD OF THE INVENTION

This invention relates to an antenna structure having a patch array antenna feed in conjunction with a parabolic dish, particularly useful in a collision detection system in a vehicle.

BACKGROUND

Automotive technologies continually strive to make vehicles safer. In one aspect of vehicle safety, it is known to provide a vehicle with means to detect potential collisions and to take appropriate actions to avoid the same. For example, vehicles have been equipped with numerous types of sensors (e.g., infra-red sensors) which are able to broadcast radiation towards a potential obstacle (a tree, building, or another vehicle for example), receive radiation reflected from that obstacle, and determine that obstacle's distance and hence its potential as a collision hazard.

A developing technology in this area comprises antenna structures operating at or near 77 GHz frequencies. Such antenna structures include the ability to transmit and detect reflected 77 GHz radiation, and thus may be referred to as transceivers. A simple illustration of such a transceiver 12 mounted in a vehicle 10 is illustrated in FIG. 1. The transceiver 12 may be mounted anywhere in the vehicle 10 so long as the transmission and detection of the radiation is not significantly impeded, and preferably may be mounted inside the bumper of the vehicle. In the specific example illustrated, the transceiver 12 is positioned in the front bumper of the vehicle allowing for assessment of potential hazards in front of the vehicle. As the broadcast radiation is preferably generally beam shaped, it is usually beneficial to cause the radiative beam to oscillate from left to right in front of the vehicle so as to "sweep" an arc-shaped sector in front of the vehicle. Using 77 GHz transceivers, the beam is usually swept between +/−10 degrees (θ) at a frequency of about 10 Hz or so, and has an effective distance for assessing potential hazards of approximately 100 meters. When such a transceiver 12 is incorporated into a vehicle 10, potential collision hazards can be detected, which is useful in its own right as a safety feature, and is further useful in other respects, for example, as input to an adaptive cruise control system which automatically slows the car when hazards are detected at a certain distance.

FIGS. 2A and 2B show the basic components of a typical transceiver 12 in further detail, including a parabolic reflector dish 16, a horn antenna 18, relevant electronics as exemplified by a printed circuit board (PCB) 22, and a substrate structure or housing 14 for mounting and/or housing the same. The PCB 22 generates and transmits the radiation 20 from the horn antenna 18, and similarly receives reflected radiation from a potential collision hazard as noted above. The horn antenna 18 is located at a focal point of the parabolic reflective surface 16*a* of the dish 16 such that radiation 20 broadcast from the horn antenna leaves the dish 16 in a generally horizontal beam, and similarly so that reflected radiation 20 is eventually focused back to the horn antenna 18 and the PCB 22 for detection. (The dish 16 as shown generally represents the "upper half" of a parabola). Other antenna configurations have been used with vehicular radar sensors, but using a parabolic antenna is generally preferred for producing a narrow beam for multiple object detection.

As noted earlier, the beam is swept (i.e., through angle θ) in any number of well known ways, for example, by causing the parabolic dish 16 to oscillate back and forth. Because such oscillation schemes are well known and not particularly important in the context of the invention, such details are not shown. However, it suffices to say that the dish 16 can be made to oscillate with respect to the housing 14 by mounting it thereto with springs or dampers to allow the dish to swivel, and by cyclically powering solenoids within the housing 14 to swivel the dish 16 by electromagnetic force.

Further details concerning the foregoing concepts and transceiver structures and controls can be found in U.S. Pat. Nos. 6,542,111; 6,646,620; 6,563,456; and 6,480,160, which are incorporated herein by reference in their entireties.

A major drawback to the collision detection transceiver 12 of the type illustrated is its cost, particularly as it related to the horn antenna 18. As a three-dimensional waveguide, the horn antenna is generally rather complex to design and manufacture, as the angles, lengths and the other various dimensions of the waveguide must be specifically tailored to give optimum performance for the radiation 20 (i.e., at 77 GHz) in question. This accordingly adds significant cost to the transceiver 12, which generally hampers use of the transceiver in vehicles that generally cannot be labored with substantial add-on costs. Moreover, from a functional standpoint, the use of the horn antenna adds additional structural complexity to the overall design of the transceiver assembly, as it essentially "sticks out" of the assembly, must be precisely coupled to the PCB 22, is susceptible to damage and misalignment, etc.

In short, room exists to improve upon existing vehicular collision detection transceivers, and this disclosure presents solutions.

SUMMARY OF THE INVENTION

In one embodiment, an improved transceiver assembly for a vehicle capable of detecting potentially hazardous objects is disclosed. The transceiver assembly comprises a patch array feed antenna having an array of a plurality of patches for generating a beam and for detecting the beam as reflected from the potential hazards. The antenna is formed in or on a housing which also contains a parabolic dish that oscillates to sweep the beam of radiation towards the potential hazards outside of the vehicle. In a preferred embodiment, approximately 77 GHz radiation is generated from and detected by the antenna.

The antenna of the transceiver assembly is preferably located at a focus of a parabolic surface of the dish, and is formed on a printed circuit board (PCB). The PCB can include a ground plane underneath the patches of the antenna, and can include additional circuitry necessary to operate the antenna. The antenna may be integral with the housing, formed on the housing, positioned within the housing, or at least partially exposed through the housing, so long as the loss of signal through any materials present on the assembly is minimized.

The patches of the antenna are preferably located at different positions on the antenna in a manner to preferentially steer the generated beam toward the dish, and are all connected to a common feed. By slightly altering the lengths of the feedlines to the patches, the phases of the various patches can be altered, with the overall effect being that the beam generated by the antenna can be generally steered toward the parabolic dish at an acute angle of incidence with respect to a plane of the patches.

The transceiver assembly is preferably mounted to or within a vehicle, such as in its bumper. The reflected signals can be transformed into a signal indicative of the potential hazard, which may in turn be sent to a vehicle communication bus to reduce a speed of the vehicle in a cruise control application, for example. Alternatively, the signal indicative of the potential hazard can be broadcast to the user, either audibly, visually, or both.

BRIEF DESCRIPTION OF THE DRAWINGS

Embodiments of the inventive aspects of this disclosure will be best understood with reference to the following detailed description, when read in conjunction with the accompanying drawings, in which.

DETAILED DESCRIPTION

Figure 1:
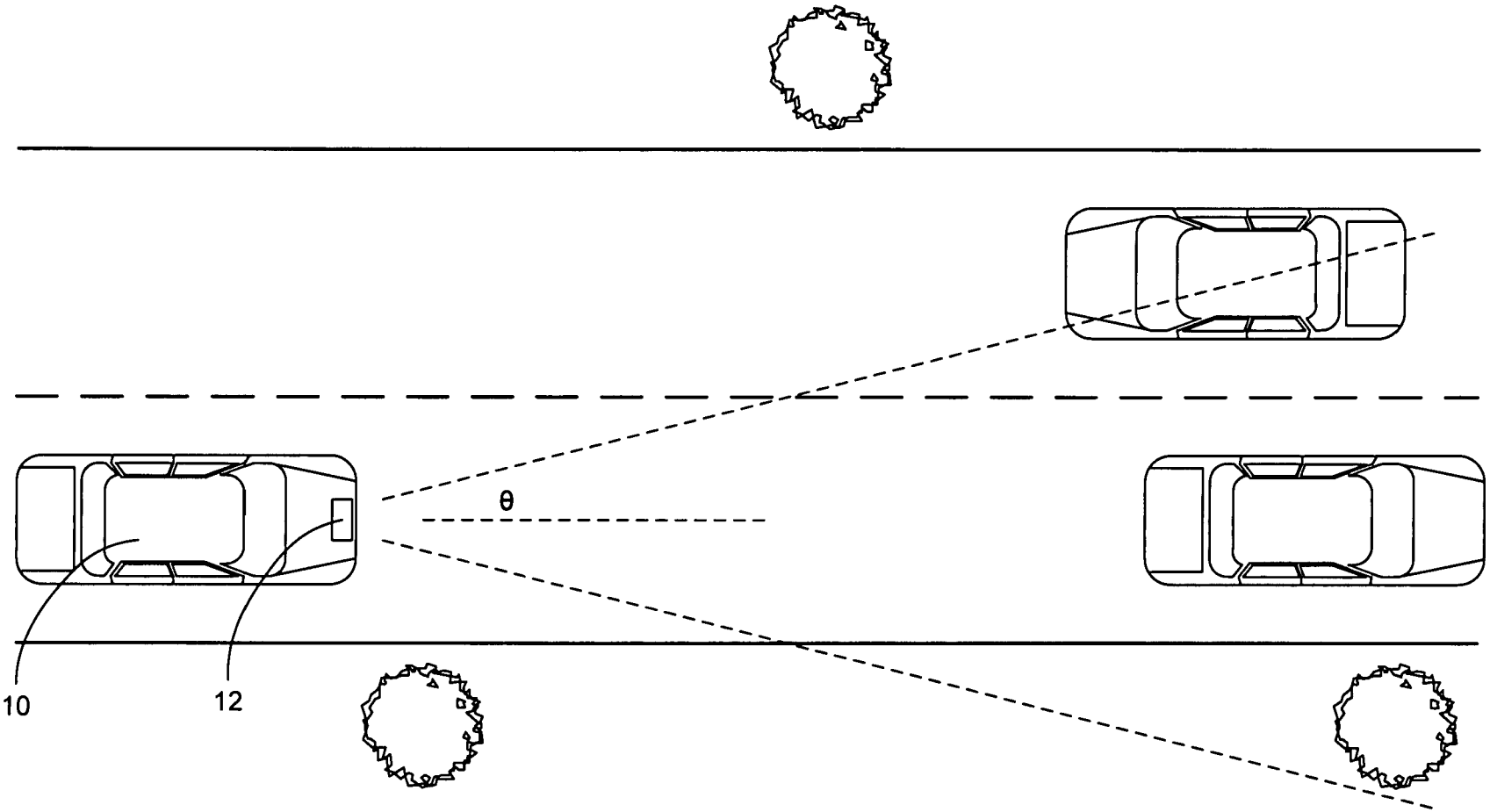
Figure 1 (prior art)
FIG. 1 illustrates use of a prior art collision detection system, in which an oscillating transceiver is incorporated into a bumper of a vehicle.
Figure 2B:
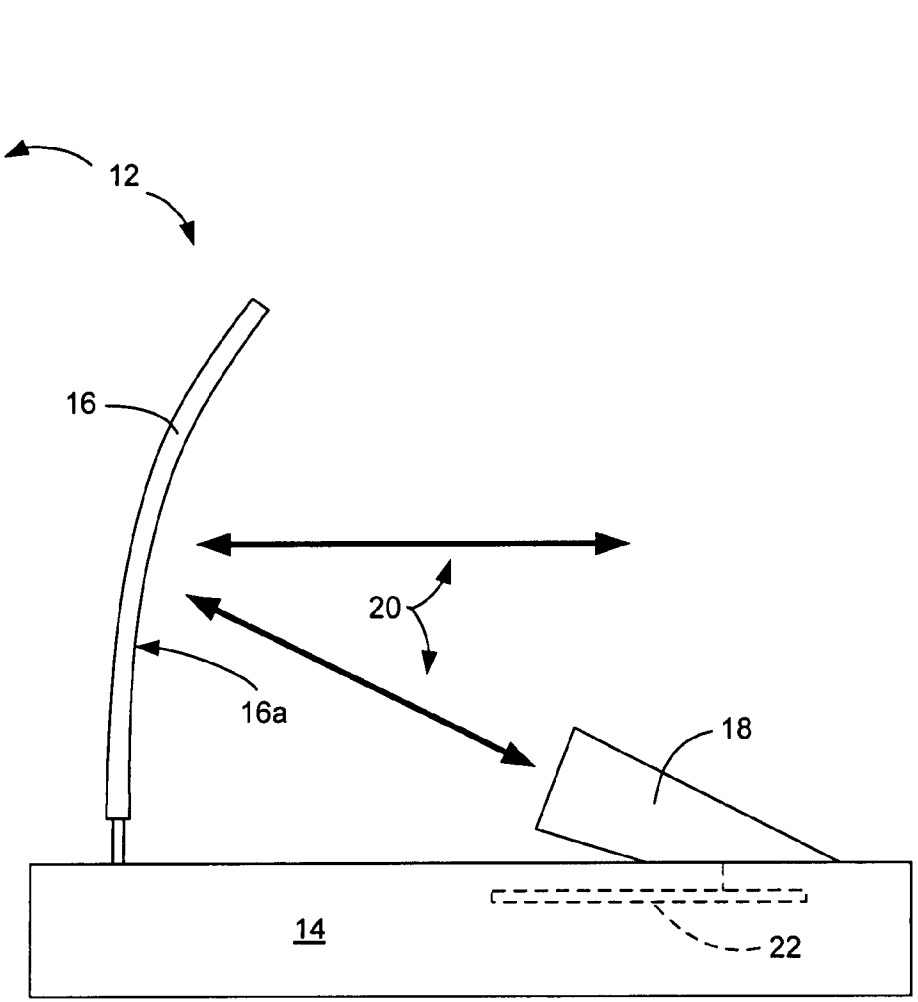
Figure 2B (prior art)
FIGS. 2A and 2B illustrate a prior art transceiver of the type illustrated in FIG. 1 incorporating the use of a horn antenna.
Figure 2A:
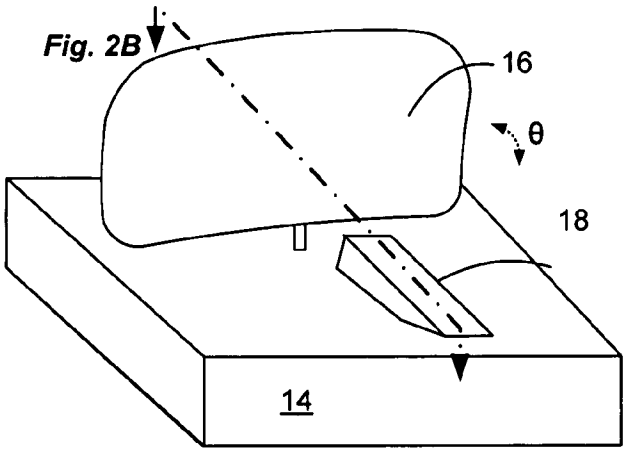
Figure 2A (prior art)
Figure 3B:
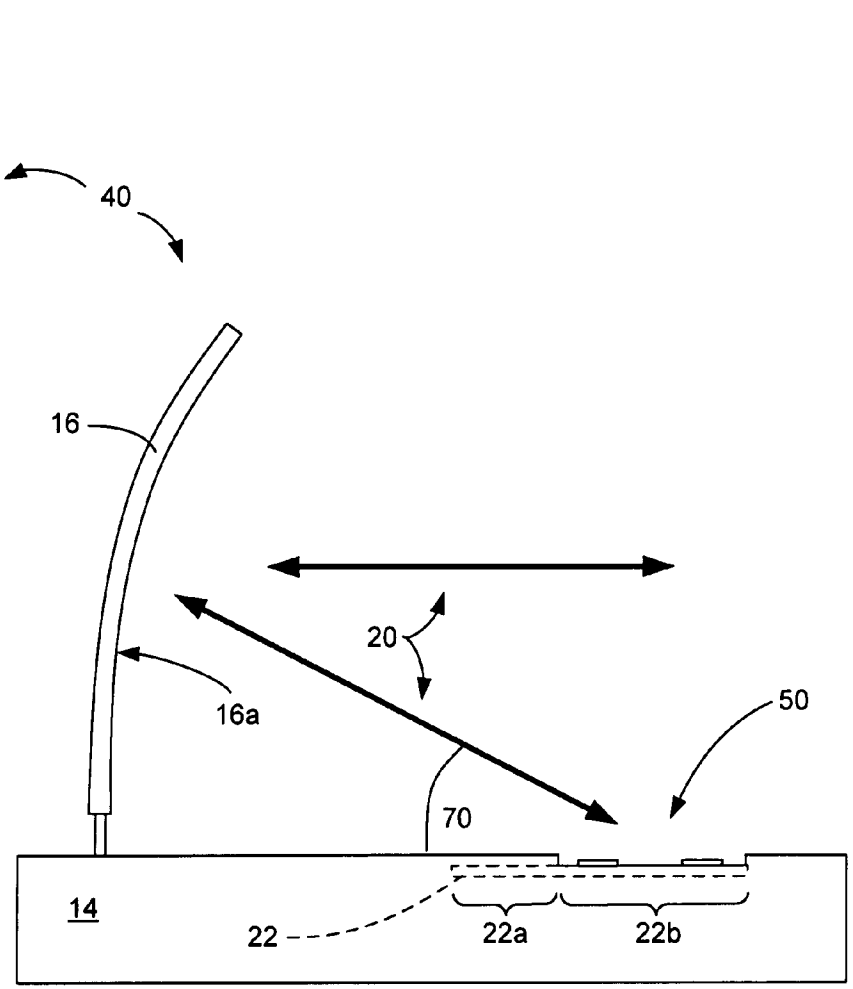
FIGS. 3A and 3B illustrate the improved transceiver, incorporating the use of a patch array feed antenna.
Figure 3A:
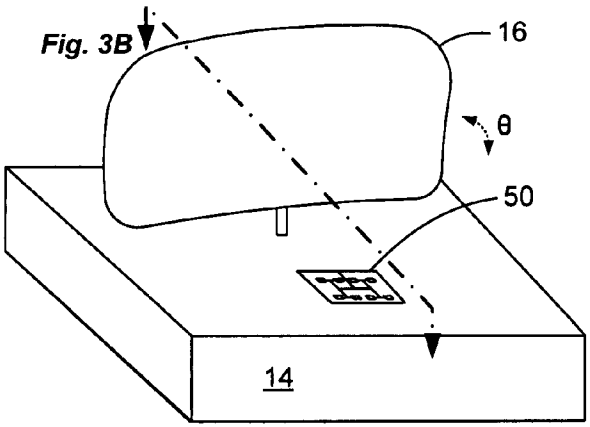

FIGS. 3A and 3B illustrate an embodiment of an improved vehicular collision detection transceiver 40 which employs a patch array feed antenna 50 in lieu of the horn antenna 18 used in prior designs (see FIGS. 2A & 2B). The patch feed antenna 50 works in a similar fashion to the horn antenna 18, i.e., it is capable of broadcasting and receiving radiation 20 and hence is useful in the context of the disclosed vehicular collision detection transceiver. However, the design of the transceiver is simplified, and is made significantly less expensive, through the use of the patch array feed antenna 50. As can be seen in FIG. 3B, and as will be made explained in further detail later, the patch array feed antenna 50 is preferably formed on the PCB (or more generically, "substrate") 22 which includes the other circuitry needed for operation of the transceiver 40. Such additional and well-known circuitry includes the oscillators or resonators necessary to form the 77 GHz radiation, other integrated circuits such as amplifiers, filters, a mixer for downconverting the detected beam as reflected from the objects, passive structures such as capacitors and inductors, and further preferably includes the processors necessary to process the detected reflected radiation to form a signal or signals which can be sent to the vehicle communication bus to indicate the detected potential hazard. The oscillators can directly create a signal at 77 GHz, or may operate at lower frequencies which are then multiplied up to 77 GHz. Because such circuitry and its manner of interfacing with a vehicle communication bus is well known, it is not shown for simplicity (see box 53, FIG. 4A).

In any event, through the use of the patch array feed antenna 50, the use of an expensive and relatively mechanically-complex horn antenna is obviated. The design provides further benefits in that the patch array feed antenna 50 can be formed onto the same PCB 22 used in the transceiver for other purposes, as just noted, in effect combining the circuitry and antenna functions into a single substrate. Moreover, the transceiver is made sleeker in its profile, as no mechanical parts (aside from the dish 16) are made to protrude from the housing 14, hence reducing alignment problems and potential damage that might result from protruding mechanical parts.

Figure 4A:
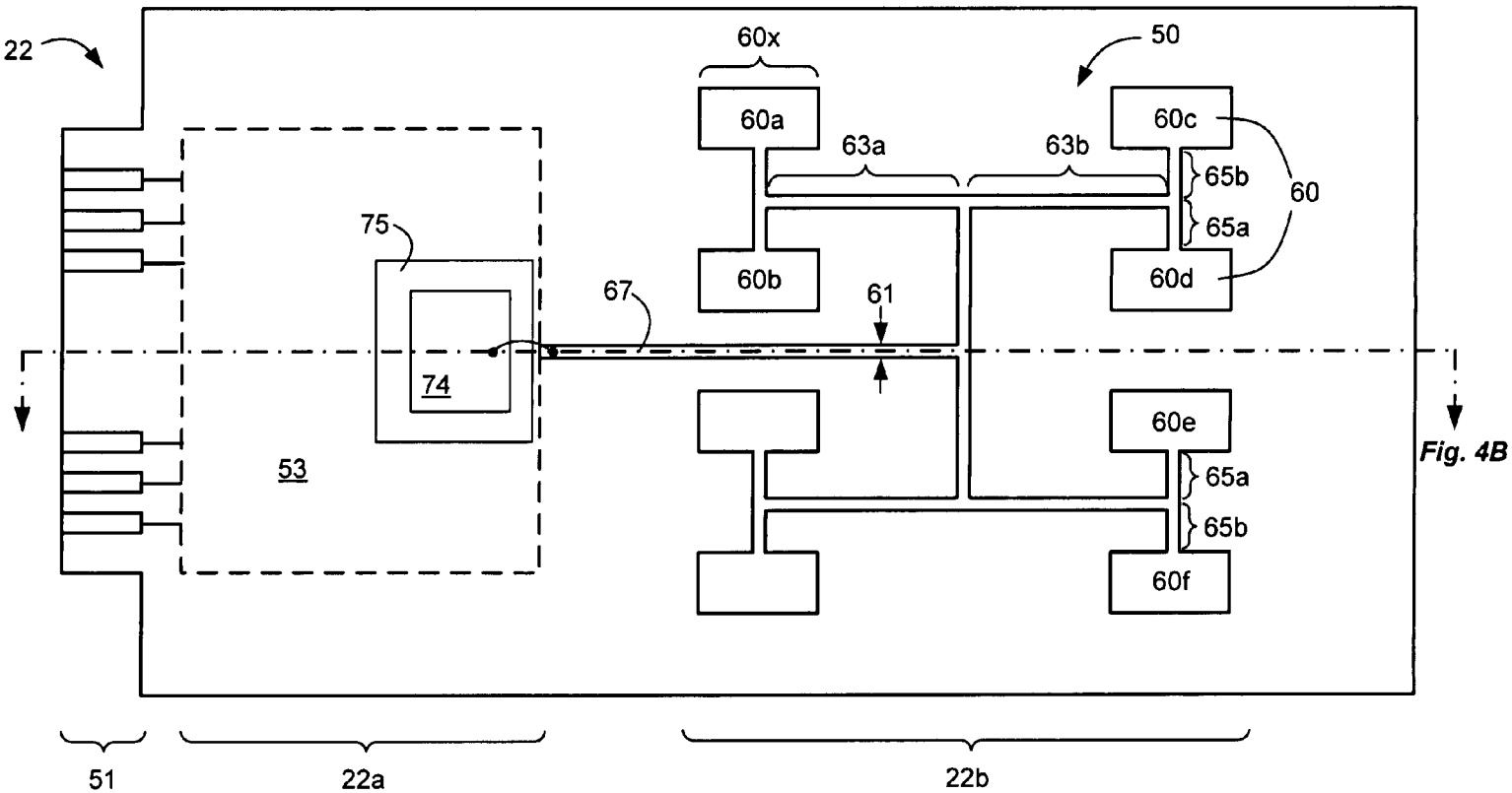
FIG. 4A illustrates an exemplary printed circuit board having the patch array feed antenna and other components.
Figure 4B:
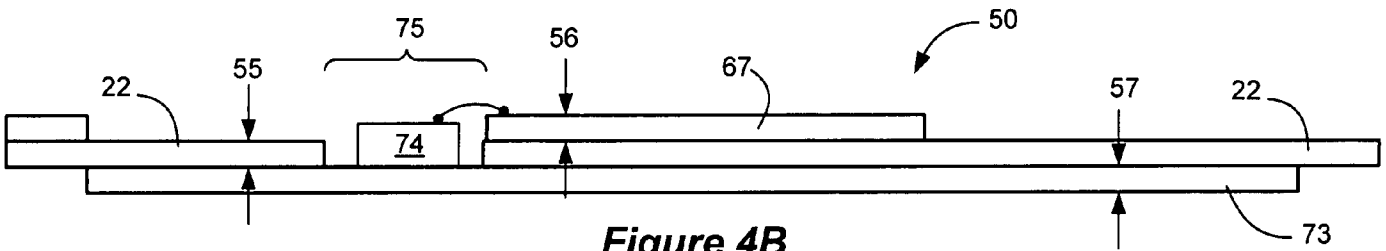
FIG. 4B represents a cross sectional view through the printed circuit board.

The patch array feed antenna 50 as formed in an exemplary embodiment on the PCB 22 is shown in further detail in FIGS. 4A and 4B. As shown, the antenna 50 is comprised of a plurality of patches 60 formed in an array (such as the 2-by-4 array shown). Each patch 60's area is generally designed to resonate at the exemplary 77 GHz frequency, and in this regard, each patch is preferably designed as a quarter-wavelength resonator. Thus, at 77 GHz, the length of a given side of each patch (such as 60*a*) would be approximately 1 millimeter in length. Overall, the entirety of the patch array feed antenna 50 would therefore range from about 5 to 20 millimeters squared depending on the number of patches 60 used and their orientation. The traces interconnecting the patches in an exemplary embodiment can have a width 61 of approximately 120 microns, and each patch is preferred coupled to a common feed 67. As one skilled in the art of antenna physics will understand, the length of the various traces is important to ensuring good resonance behavior on part of the patch array feed antenna 50, as is further explained below. Other types of non-direct feed mechanisms can be used as well to energize the patches, such as those premised on coupling principles, such as are disclosed in Ramesh Garg, "Microstrip Antenna Design Handbook," published by Artech House, pp. 28–29 (2001), which is incorporated herein by reference.

The other circuitry needed for operation of the transceiver 40 (such as the oscillators, tuners, receivers, etc.) is represented generally by circuit block 53, as mentioned above. One exemplary integrated circuit in circuit block 53 is shown as integrated circuit 74, which might comprise the oscillator for example. As shown, the integrated circuit 74 is preferably a "bare die," i.e., an unpackaged integrated circuit. As one skilled in the art will understand, the use of bare dies are preferable when operating at high frequencies such as 77 GHz, as packaging the integrated circuits can add unwanted parasitic capacitance and inductance. As shown in FIGS. 4A and 4B, a connection is established between the integrated circuit 74 and the common feed 67, which as shown comprises a bond wire as is used traditionally in semiconductor manufacturing. (Of course, additional integrated circuits could also be connected to the common feed 67, but this is not shown for clarity). Although only one bond wire is shown, additional bond wires in parallel could be used and the use of such multiple connections is preferable to improve electrical coupling between the integrated circuit 74 and the common feed 67. Other connecting means such as a ribbon bond could also be used, for example. Generally this connection should be as short, flat, and mechanically resilient as possible.

In one embodiment, the integrated circuit 74 is placed in a hole 75 in the PCB 22, which can be milled in the PCB 22. This allows the integrated circuit to be conductively epoxied to the ground plane 73 under the PCB 22 to improve the grounding stability of the patch array feed antenna 50. Of course, the disclosed embodiment for mounting the integrated circuits 74 within circuit block 53 and for coupling the same to the common feed 67 are merely exemplary, and other means could be used as one skilled in the art will appreciate.

Once the PCB 22 is formed, care should be taken not to damage any exposed connections, such as the bond wires. Accordingly, the circuitry can be covered by a low-loss cap or lid to protect the components and connection, and/or appropriate recesses can be formed in the housing 14 to allow clearance for such components and connections. See, e.g., the above-incorporated patent application for further details. In one embodiment, the cap or lid can comprise the radome, discussed in further detail below. Such components may also be covered with a protective epoxy once formed, but this is less preferred as it might add additional capacitance and inductance to the circuitry and hamper performance.

The PCB 22 can also include a connector portion 51 suitable for connecting the PCB and its traces to an edge connector (not shown), which for example might couple to a vehicle communication bus (not shown). The various leads in the connector portion 51 would carry power, control and data (i.e., reflection data) between the PCB 22 and the vehicle in which the transceiver 40 is placed. For example, when a reflected signal is detected through its resonance of the antenna 50, that signal is preferably processed at circuit block 53 and causes a signal (i.e., indicator) to be sent to a lead or leads on the connector portion to inform the vehicle of the detected potential hazard. Such signal can then be sent by the vehicle communication bus to the control system of the vehicle, for example, to cause the vehicle to reduce its speed. Or, such signal might merely be audibly broadcast to a user of the vehicle (e.g., a "beep" or a warning voice message), or displayed to the user (e.g., a lit LED or an indication on an interface screen), or both. Alternatively, processing of the reflected signals can be performed off of the PCB 22.

Generally, radiation 20 will emit from each patch 60 orthogonal to its surface (i.e., straight upwards). See David M. Pozar, "Microwave Engineering," published by Addison-Wesley, pp. 183–184 (1990), which is incorporated herein by reference. However, in a preferred embodiment, the patches 60 of the patch array feed antenna 50 provide the ability to "steer" the emitted or received beam of radiation 20. As can be best seen from FIG. 3B, it is desirable that the antenna direct as much energy as possible toward the parabolic dish 16. Thus, as shown in that Figure, it is desired to generally focus the radiation to the left, as radiation emitted to the right or upwards will generally be "lost" and unusable in the formation of a horizontal beam from the dish 16. Such steering from the patch array feed antenna 50 is made possible in any of several different ways as one skilled in the art will recognize, but in a preferred embodiment steering is accomplished by altering the phase at which each patch 60 radiates, which in turn can be dictated by the lengths of the traces that feed them.

Accordingly, each of the patches 60 is laid out at slightly different distances or locations on the PCB 22. For example, consider traces 63*a* and 63*b* in FIG. 4A. If it is desired to generally steer the radiation to the left of the PCB 22, the phases at which the patches 60 connected to these traces (i.e., 60*a*–60*d*) can be varied by adjusting the lengths of the traces (i.e., feedlines) such that the length of trace 63*b* is slightly longer or shorter (e.g., by tens of microns) than the length of trace 63*a*. The overall effect, when constructive and destructive interference of the radiation from the patches 60*a–d* is considered, is that the radiation will generally be directed towards the left as desired, with the acuteness of the angle of incidence (70, FIG. 3B) towards the dish 16 being dictated by the difference in distance. Specific details regarding the various lengths of traces to be used is not necessary, as one skilled in the art of antenna physics well understands how to steer radiation from a patch array feed antenna, and recognizes that some degree of routine experimentation might be required to achieve the desired result, considering such factors as trace width and thickness, the dielectric constant of the PCB 22, etc.

A cross section of the PCB 22 is shown in FIG. 4B. In a preferred embodiment, a high quality PCB material with a low dielectric constant and a low loss tangent is desired given the high frequencies with which the PCB 22 will be used. Thus, standard FR4 PCB materials may not be acceptable to properly function at 77 GHz without significant loss of signal. Instead, the PCB 22 may be formed of Duroid™ material (i.e., a glass microfiber reinforced polytetrafluoroethylene (PTFE) composite) or other high frequency laminates, such as is available from Rogers Corporation of Rogers Connecticut. (See http://www. rogerscorporation-.com/a cm/index.htm). Additionally, ceramic substrates (such as low-temperature co-fired ceramics), liquid crystal polymers substrates, and or foam substrates can be used as the material for PCB 22. Ideally, the thickness 57 of the PCB 22 is approximately 2 mils thick. The metallic traces and patches 60 formed on the PCB 22 are preferably corrosion resistant which is desirable given the harsh conditions in which the transceiver 40 will be used in a vehicular environment. Accordingly, such traces and their associated patches 60 are preferably gold, or copper, or at least gold coated. The thickness of the top traces and patches 56 and the thickness of the ground plane 57 can be approximately 10 to 20 microns, and obviously is not drawn to scale in FIG. 4B.

Although a preferred embodiment is described, one skilled in the art of antenna physics will understand that the desired functionality of the patch array feed antenna 50 can be achieved in many different ways. The number of patches, their size, the nature in which they are arrayed, their respective distances, the materials used to form them, the frequencies at which they resonate, etc., can be easily varied to arrive at any number of variations. The antenna could be in the form of another well known planar antenna, such as a printed dipole, so long as the radiation pattern is perpendicular to the surface but has a wide beam suitable for steering at acute angles. Accordingly, none of these parameters is crucial, and the invention should not be understood as limited to any of these particulars as disclosed. Moreover, while particularly useful in the broadcast and detection of 77 GHz radiation, the disclosed patch array feed antenna 50 can be used with (and tailored for) other frequencies as well. For example, future transceiver assemblies may use even higher frequencies, such as 140 GHz, 220 GHz, or any other publicly available band, with the use of such higher frequencies allowing the antenna to be made smaller and/or more directive.

The overall construction of the vehicular collision detection transceiver 40 is likewise susceptible to various modifications. As shown in FIG. 3B, only that portion 22*b* of the PCB 22 containing the patch array feed antenna 50 is generally exposed through the housing 14, while other portions 22*a* of the PCB 22 (i.e., those containing the other necessary circuitry 53) are covered. This is generally preferred to reduce loss between the antenna 50 and the dish 16 while still protecting the circuitry. However, this is not strictly necessary, as the entirety of the PCB 22, including portion 22*b* can be covered by the housing 14 so long as the housing is not generally reflective (i.e., metallic) in a manner to interfere with the transceiver 40's use. In this regard, it should also be noted that it is preferable that the bumper or other structure on the vehicle in which the transceiver is placed (mounting not shown) be similarly transmissive to the radiation emitted from and detected by the transceiver. (For example, the bumper would preferably be free of metallic paint). Of course, some degree of loss is inevitable and permissible. Ultimately, the entirety of the transceiver 40 would be encapsulated within a low-loss radome (not shown) to protect the transceiver from the harsh conditions in which it will operate within a vehicle, as is well known. As alluded to earlier, if exposed circuitry and/or connections are present, care should be taken to mount the PCB 22 to or within the housing 14 in such a manner as to mechanically protect such structures, such as by the use of recesses, spacers, protective caps or lids, etc.

A "patch" as used herein should be understood as referring to any planar element capable of radiating orthogonally to the substrate on which it is formed. Thus, a "patch" need not be strictly rectilinear is shape, but includes shapes such as lines, squares, rectangles, and other more complex shapes such as spirals or shapes containing notches capable of radiating orthogonally to the substrate. Consistent with this understanding, a "patch" should also be understood to refer to the absence of metallization, and can actually refer to a portion of a "slot antenna," such as those that comprise a slot in the ground plane of a grounded substrate, including printed dipole antennas and microstrip traveling-wave antennas. See Ramesh Garg, "Microstrip Antenna Design Handbook," published by Artech House, pp. 8–14 (2001), which is incorporated herein by reference.

While preferably disclosed as a having a parabolic reflector dish 16, one skilled in the art will understand that the disclosed transceiver 40 may be formed using other types of reflectors. For example, the dish 16 may be replaced by a "reflectarray," which essentially constitutes a plurality of patches tuned to reflect radiation similarly to a parabolic antenna. See Pozar, "Design of Millimeter Wave Microsrtip Reflectarrays," IEEE Transactions on Antennas and Propagation, Vol. 45, No. 2, pp. 287–296 (February 1997), which is incorporated herein by reference.

The disclosed antenna could also be designed for specific polarizations of the radiation 20, which is useful because some objects being detected might reflect certain polarizations differently. See Ramesh Garg, "Microstrip Antenna Design Handbook," published by Artech House, pp. 493–497 (2001), which is incorporated herein by reference.

Although disclosed in the context of being useful within a vehicle, the disclosed transceiver assembly can be used in other contexts as well to detect the presence of objects other than those present while driving.

It should be understood that the inventive concepts disclosed herein are capable of many modifications. To the extent such modifications fall within the scope of the appended claims and their equivalents, they are intended to be covered by this patent.

What is claimed is:

1. A transceiver assembly for detecting objects, comprising:

a reflector coupled to a housing, wherein the reflector moves to sweep a beam of radiation to detect the objects and to receive the beam as reflected from the objects; and an antenna comprising a plurality of patches coupled to a common feed for generating the beam and for detecting the beam as reflected from the objects.

2. The transceiver assembly of claim 1, wherein the antenna is located at a focus of a parabolic surface of the reflector.

3. The transceiver assembly of claim 1, wherein the antenna is formed on a substrate.

4. The transceiver assembly of claim 3, wherein the substrate is selected from a group consisting of a glass microfiber reinforced polytetrafluoroethylene composite, a liquid crystal polymer material, a low-temperature co-fired ceramic material, and a foam material.

5. The transceiver assembly of claim 3, wherein the substrate comprises a ground plane underlying the antenna.

6. The transceiver assembly of claim 3, wherein the substrate further comprises additional circuitry to operate the antenna.

7. The transceiver assembly of claim 6, wherein the additional circuitry comprises an oscillator to generate the beam, and a mixer for downconverting the detected beam as reflected from the objects.

8. The transceiver assembly of claim 1, wherein the antenna is integral with the housing.

9. The transceiver assembly of claim 8, wherein the antenna is formed on the housing.

10. The transceiver assembly of claim 1, wherein the antenna is positioned within the housing.

11. The transceiver assembly of claim 10, wherein the antenna is at least partially exposed through the housing.

12. The transceiver assembly of claim 1, wherein the patches are located at different positions on the antenna in a manner to preferentially steer the generated beam toward the reflector.

13. The transceiver assembly of claim 1, wherein the patches are fed with different phases to preferentially steer the generated beam toward the reflector.

14. The transceiver assembly of claim 1, wherein the radiation is approximately 77 GHz.

15. The transceiver assembly of claim 1, wherein the generated beam is generated at an acute angle of incidence with respect to a plane of the patches.

16. A transceiver assembly for a vehicle, comprising:

a reflector coupled to a housing, wherein the reflector moves to sweep a beam of radiation to detect objects outside of the vehicle; and an antenna comprising an array of a plurality of patches for generating the beam and for detecting the beam as reflected from the objects.

17. The transceiver assembly of claim 16, wherein the antenna is located at a focus of a parabolic surface of the reflector.

18. The transceiver assembly of claim 16, wherein the antenna is formed on a substrate.

19. The transceiver assembly of claim 18, wherein the substrate is selected from a group consisting of a glass microfiber reinforced polytetrafluoroethylene composite, a liquid crystal polymer material, a low-temperature co-fired ceramic material, and a foam material.

20. The transceiver assembly of claim 18, wherein the substrate comprises a ground plane underlying the antenna.

21. The transceiver assembly of claim 20, wherein the substrate further comprises additional circuitry to operate the antenna.

22. The transceiver assembly of claim 16, wherein the antenna is integral with the housing.

23. The transceiver assembly of claim 22, wherein the antenna is formed on the housing.

24. The transceiver assembly of claim 16, wherein the antenna is positioned within the housing.

25. The transceiver assembly of claim 24, wherein the antenna is at least partially exposed through the housing.

26. The transceiver assembly of claim 16, wherein the patches are located at different positions on the antenna in a manner to preferentially steer the generated beam toward the reflector.

27. The transceiver assembly of claim 16, wherein the patches are fed with different phases to preferentially steer the generated beam toward the reflector.

28. The transceiver assembly of claim 16, wherein the radiation is approximately 77 GHz.

29. The transceiver assembly of claim 16, wherein the transceiver assembly is mounted within a vehicle.

30. The transceiver assembly of claim 16, wherein the transceiver assembly is mounted within a bumper on the vehicle.

31. The transceiver assembly of claim 16, wherein the patches are all connected to a common feed.

32. The transceiver assembly of claim 16, wherein the generated beam is generated at an acute angle of incidence with respect to a plane of the patches.

33. A vehicle having a transceiver assembly for detecting objects outside of the vehicle, comprising:

a transceiver assembly mounted to or within the vehicle, the assembly comprising:

a reflector coupled to a housing, wherein the reflector moves to sweep a beam of radiation to detect objects outside of the vehicle;

an antenna comprising an array of a plurality of patches for generating the beam and for detecting the beam as reflected from the objects; and circuitry to process the detected reflected beam to provide an indication of the object.

34. The vehicle of claim 33, wherein the antenna is formed on a substrate.

35. The vehicle of claim 34, wherein the substrate further comprises the circuitry to process the detected reflected beam.

36. The vehicle of claim 33, wherein the patches are located at different positions on the antenna in a manner to preferentially steer the generated beam toward the reflector.

37. The vehicle of claim 33, wherein the patches are fed with different phases to preferentially steer the generated beam toward the reflector.

38. The vehicle of claim 33, wherein the radiation is approximately 77 GHz.

39. The vehicle of claim 33, wherein the transceiver assembly is mounted within a bumper on the vehicle.

40. The vehicle of claim 33, wherein the patches are all connected to a common feed.

41. The vehicle of claim 33, wherein the indication comprises a signal to a vehicle communication bus to reduce a speed of the vehicle.

42. The vehicle of claim 33, wherein the indication comprises an indication to a user of the vehicle.

43. The vehicle of claim 33, wherein the indication is either audible, visual, or both.

* * * * *